United States Patent [19]

Immel et al.

[11] Patent Number: 4,630,780

[45] Date of Patent: Dec. 23, 1986

[54] REPLACEABLE BEVELED SHEAR MEMBERS FOR A WASTE PULPING MACHINE

[75] Inventors: Robert W. Immel, Newtown Square; Evan P. Fields, Pomeroy, both of Pa.

[73] Assignee: Somat Corporation, Pomeroy, Pa.

[21] Appl. No.: 686,014

[22] Filed: Dec. 24, 1984

[51] Int. Cl.[4] ..... B02C 18/42

[52] U.S. Cl. ..... 241/46 B; 241/46.06; 241/74; 241/100.5

[58] Field of Search ..... 241/74, 100.5, 46 A, 241/46 B, 46 R, 46.06, 46.08, 257 G, 294, 286, 293, 300.1

[56] References Cited

U.S. PATENT DOCUMENTS

| | | | |
|---|---|---|---|
| 3,186,652 | 6/1965 | Hardy et al. | 241/46.08 X |
| 3,236,462 | 2/1966 | Stout | 241/46 B |
| 3,314,617 | 4/1967 | Sargood | 241/294 X |

*Primary Examiner*—Mark Rosenbaum

*Attorney, Agent, or Firm*—Kane, Dalsimer, Kane, Sullivan and Kurucz

[57] ABSTRACT

Waste materials are introduced into an impeller-created vortex of water and reduced to a pulp wherein the impeller is provided with one or more blades constructed and arranged to cooperate with one or more stationary blades on a sieve surrounding the impeller. The impeller blades, stationary blades, and components of the sieve comprise readily removable and changeable components. The shear blades provide edges which periodically mate upon rotation of the impeller to provide a desired shearing action for the waste pulping machine. The shear members may readily and easily be removed when they become worn or damaged. The stationary shear blades are provided with a beveled edge in order to assists the flow of debris. The beveled edge reduces the likelihood of silverware or untensil becoming wedged between the impeller blades and the stationary shear blades.

10 Claims, 5 Drawing Figures

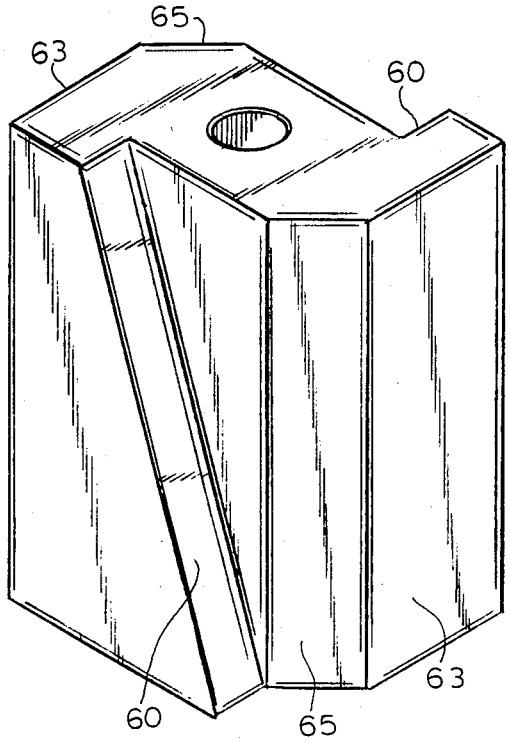
FIG.1
FIG.2
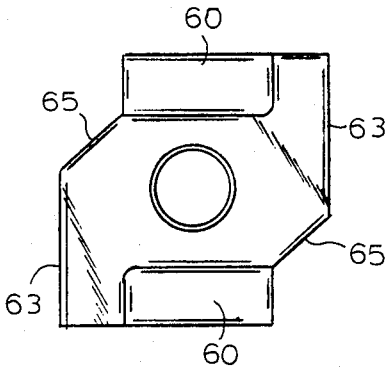
FIG.3
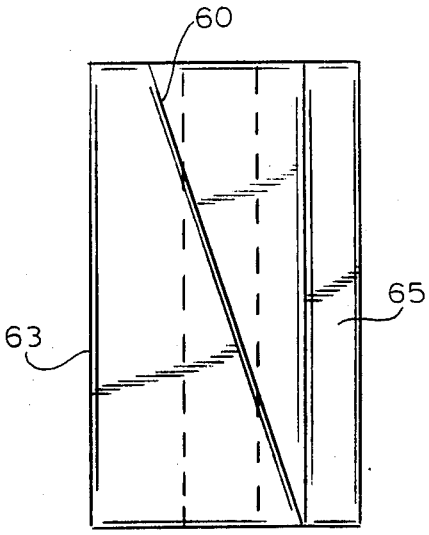

REPLACEABLE BEVELED SHEAR MEMBERS FOR A WASTE PULPING MACHINE

BACKGROUND OF THE INVENTION

The present invention relates to the art of waste disposal and, more particularly, to the field of wet pulping equipment for use in waste disposal.

The application of wet pulping equipment for waste disposal is finding increasing acceptance. In equipment of this type, waste materials are introduced into an impeller-created vortex of water, reduced to a pulp, passed on to a water extraction device where the excessive water is separated and returned to the pulper for reuse. Such waste pulping machines are often provided with one or more blades mounted to the impeller to provide a shearing action as the impeller is rotated. The blades serve to enable the pulping equipment to handle a quantity of non-pulpable material, such as plastic, which generally constitutes a minor portion of the waste to be disposed.

One problem encountered with such equipment is that the shearing blades become dull or damaged through normal use. Heretofore replacement of the blades required considerable effort since the blades were permanently bonded in position.

It is therefore a principal object of the present invention to provide an improved waste pulping machine provided with shearing blades which may readily be replaced in time as the blades become worn or damaged.

Another problem encountered with such equipment is that silverware and other utensils would become wedged between the rotating impeller blades and the stationary shear blades and the subsequent pressure would cause the top security ring to bulge and deform.

Therefore, another principal objective of the present invention is to provide an improved waste pulping machine provided with beveled stationary shearing blades so as to eliminate the jamming of the impeller and the resulting deformation of the top security ring.

SUMMARY OF THE INVENTION

The above and other beneficial advantages are attained by providing a waste pulping machine of the type described in U.S. Pat. No. 3,885,745, Hankes et al., in which waste materials are introduced into an impeller-created vortex of water and reduced to a pulp wherein the impeller is provided with one or more blades constructed and arranged to cooperate with one or more stationary blades on a sieve surrounding the impeller. The impeller blades, stationary blades, and components of the sieve comprise readily removable and changeable components. The shear blades provide edges which periodically mate upon rotation of the impeller to provide a desired shearing action for the waste pulping machine. The shear members may readily and easily be removed when they become worn or damaged. The stationary shear blades are provided with a beveled edge in order to assist the flow of debris. The beveled edge reduces the likelihood of silverware or a utensil becoming wedged between the impeller blades and the stationary shear blades.

DESCRIPTION OF THE DRAWINGS

FIG. 1 is an enlarged perspective view depicting a beveled stationary shear member;

FIG. 2 is a top plan view of the beveled stationary shear member;

FIG. 3 is a side elevational view of the beveled stationary shear member;

DETAILED DESCRIPTION OF THE PREFERRED EMBODIMENT

Figure 4:
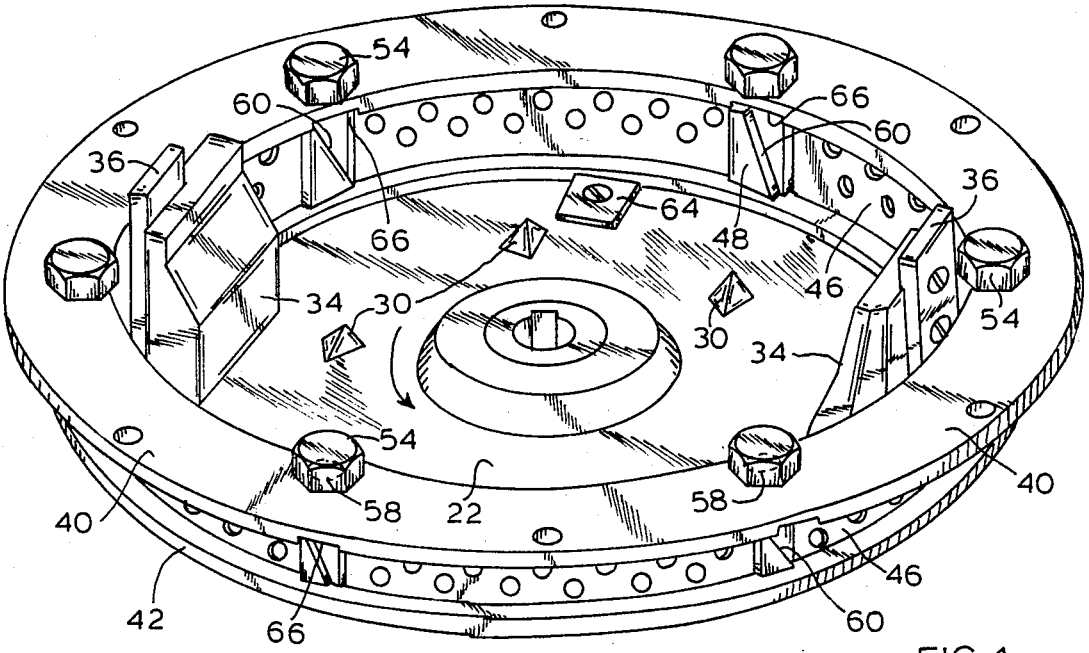
FIG. 4 is an enlarged perspective view showing the rotating shear members secured to the pulping machine impeller and the associated fixed, beveled shear members.

Reference is now made to the drawings wherein similar components bear the same reference numerals throughout the several views. In FIG. 4, impeller 22 is provided with a plurality of cutting teeth 30 on its upper surfaces. The impeller upper surface further includes shear member supports 34 extending upwardly. A shear member or blade 36 is removably mounted to each of the supports. Although two shear blades are shown mounted on the impeller of this embodiment, the actual number employed is a matter of choice.

The sieve comprises a plurality of identical arcuate perforate members 46. The bottom edges of members 46 seat in a recess extending about the upper surface of bottom ring 42 and the upper edges of members 46 seat in a similar ring extending about the bottom edge of top ring 40.

Figure 5:
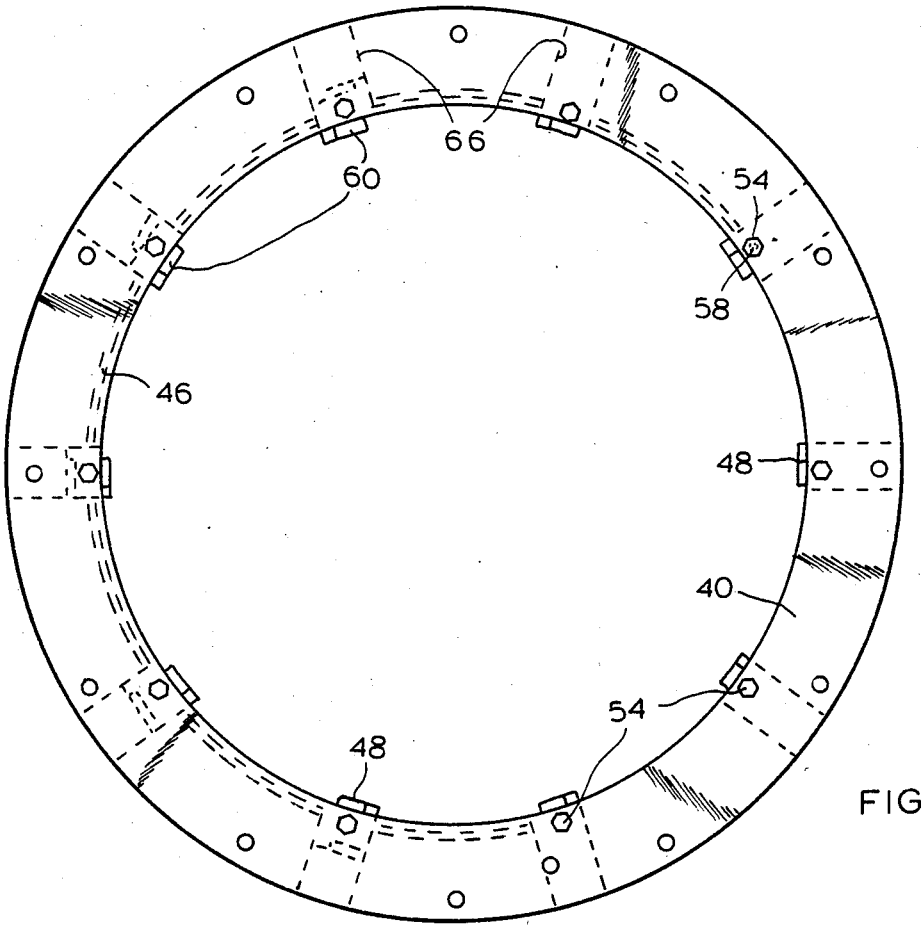
FIG. 5 is a top plan view showing the top security ring.

As shown in FIG. 5, a plurality of stationary shear blade members 48 are provided interposed between the arcuate members 46. These shear blade members 48 seat on the top surface of bottom ring 42 interposed between two adjacent arcuate members 46. A bolt 54 passes through an opening 58 in the top ring to capture the shear member 48 and maintain the vertical alignment.

Each stationary shear blade member is mounted so that an edge of each portion periodically mates with the forward edge of shear member 36 as the impeller rotates. To this end, referring to FIG. 5, it can be seen that the edge 60 of each stationary shear blade member 48 will periodically come in contact with the moving blade member 36 upon rotation of the impeller thereby producing a cutting action similar to that of a scissor. This edge 60 is beveled so that any non-pulpable solid matter, such as silverware, will be pushed aside and thus prevent harm to the pulping equipment. The shear blade member 48 is provided with another beveled side 65. Beveled side 65 causes any solid, non-pulpable matter to be directed toward beveled edge 60 as the moving shear blade member 36 rotates and thus be harmlessly pushed aside so that the two blade members, 48 and 36 will not jam on the solid matter and thus deform the top security ring 40 or damage the impeller motor.

As is shown in FIGS. 1, 2 and 3, the stationary blade member 48 has two opposite beveled edges 60 and beveled sides 65. In this manner as edge 60 becomes worn, a new edge may be provided by rotating the blade portions 180°. This can easily be effected by removing bolt 54, rotating the shear member and then replacing the bolt. When both edges 60, of shear member 48, are worn the shear member portions may be replaced. In a similar fashion, when the shearing edge of member 36 is worn, it may easily be unscrewed and replaced. Inadvertent rotation of the stationary blade portions 48 is prevented by slots 66 in top ring 40.

During operation waste is pulped through the action of the impeller teeth until reduced to a size where the solids can pass through the openings in sieve 46. If during the operation of the device a shearing edge becomes worn or damaged, that edge may readily be replaced in the manner described above. That is, in the case of the stationary shear members, a new shear edge may be rotated in position until both the edges are worn, at which time the shear blade portions must be replaced. Similarly, in the case of the impeller mounted shear members, as their edges become worn they may readily be unscrewed and replaced. Also, if the sieve is damaged, only the damaged section 46 need be replaced.

Thus, in accordance with the above, the aforementioned objects are effectively attained.

What is claimed is:

1. A pulping apparatus for comminuting waste material comprising:

a rotary disc impeller;

a sieve ring encircling said impeller, said sieve ring having a bottom edge and a top edge and being formed with a plurality of through apertures;

at least one first shear means support means secured to said impeller;

at least one second shear means support means secured stationary with respect to said rotary impeller;

first shear means removably mounted to said first shear member support means;

second shear means mounted to said second shear means support means, said second shear means extending between said top and bottom edge of the sieve ring and interposed between sections of the sieve ring, said second shear means having at least two cutting edges spaced apart a predetermined amount, said second shear means being rotationally adjustably mounted to said second shear means support means so that upon rotational adjustment, a different cutting edge comes into play; said first shear member having a cutting edge for periodically coming into play with a cutting edge of said second shear means portions upon rotation of said impeller; said cutting edge of said second shear means having a beveled cutting edge inclining in the direction of rotation of the rotary disk impeller so that unpulpable material is pushed above the shear member and away from the impeller.

2. The pulping apparatus in accordance with claim 1 further comprising a plurality of identical interchangeable arcuate sections of the sieve ring and an equal plurality of second shear means interposed between said arcuate sections forming a continuous sieve and forming securing walls preventing the inadvertent rotation of said second shear means.

3. The pulping apparatus in accordance with claim 1, wherein the cutting edges of the second shear means are 180° apart.

4. The pulping apparatus in accordance with claim 1, comprising a beveled side adjacent the cutting edge of the second shear member so that unpulpable debris is guided to the beveled cutting edge of the second shear means.

5. The pulping apparatus in accordance with claim 1 wherein the cutting edge is beveled in a manner so that a forward edge of the cutting edge is adjacent to the lower edge of the sieve ring and a rearward edge of the cutting edge is adjacent the top edge of the sieve ring.

6. The pulping apparatus in accordance with claim 1 wherein the apparatus is a wet pulping apparatus and wherein the rotary disc impeller creates a vortex in a working liquid to convey waste into the shear members.

7. The pulping apparatus according to claim 1 comprising a plurality of first and second shear means support means, each having a shear means removably mounted thereto.

8. A pulping apparatus for wet pulping waste material comprising a rotary disc impeller for creating a vortex in a working liquid to convey waste;

a sieve ring encircling said impeller, said sieve ring having a bottom edge and a top edge and being formed with a plurality of through apertures said sieve ring mounted between a top security ring and a lower ring;

first shear means support means secured to said impeller;

second shear means support means secured stationary with respect to said impeller;

a first shear means removably mounted to said first shear member support means;

a second shear means mounted to said second shear means support means said second shear means extending between said top and bottom edge and interposed between sections of the sieve ring, said second shear means having at least two cutting edges spaced apart a predetermined amount, said second shear means being rotationally adjustably mounted to said second shear means support means so that upon rotational adjustment, a different cutting edge comes into play; said first shear member having a cutting edge for periodically coming into play with a cutting edge of said second shear means portions upon rotation of said impeller; said cutting edge of said second shear means having a beveled cutting edge inclining in the direction of rotation of the rotary disk impeller so that unpulpable material is pushed above the shear member and away from the impeller wherein the sieve ring further comprises a plurality of identical interchangeable arcuate sections and an equal plurality of second shear means interposed between said arcuate sections forming a continuous sieve and forming securing walls preventing the inadvertent rotation of said second shear means, further comprising a beveled side adjacent to the beveled cutting edge of the second means, said beveled cutting edge having a forward edge adjacent the lower ring and a rearward point adjacent to the upper security ring, the slope of said beveled cutting edge being a straight line.

9. For use in a pulping apparatus for comminuting waste material having a rotary disc impeller, a sieve ring encircling said impeller, first shear means and first shear means support means secured to said impeller and second shear means and second shear means support means secured stationary with respect to said impeller: a shear element for use with the second shear means comprising a body, at least two cutting edges affixed to the body and spaced apart a predetermined amount, rotational means through a center portion of said body for permitting rotational adjustment and changing of the cutting edges, the cutting edges being inclined, inclining in a direction of rotation of said impeller in order to push unpulpable material upwardly of the shear means, the body further comprising beveled sides adjacent the cutting edges so that unpulpable debris is pushed to the inclining cutting edges.

10. The invention in accordance with claim 9, wherein the cutting edges of the second shear means are 180° apart.

* * * * *